United States Patent [19]

Imanishi

[11] 4,393,682

[45] Jul. 19, 1983

[54] FEED BAR DRIVING APPARATUS FOR A TRANSFER PRESS

[75] Inventor: Shozo Imanishi, Sagamihara, Japan

[73] Assignee: Aida Engineering, Ltd., Kanagawa, Japan

[21] Appl. No.: 290,969

[22] Filed: Aug. 7, 1981

[30] Foreign Application Priority Data

Mar. 6, 1981 [JP] Japan ..... 56-31963

[51] Int. Cl.[3] ..... B21D 43/04; B21D 43/05; B65G 25/02

[52] U.S. Cl. ..... 72/405; 72/421; 198/621

[58] Field of Search ..... 72/405, 421, 422; 198/621

[56] References Cited

U.S. PATENT DOCUMENTS

| | | | |
|---|---|---|---|
| 3,105,399 | 10/1963 | Strugala et al. | 72/405 |
| 3,434,328 | 3/1969 | Taniguchi et al. | 72/405 |
| 4,024,749 | 5/1977 | Taniguchi et al. | 72/421 |
| 4,038,862 | 8/1977 | Yamashita | 72/421 |
| 4,149,400 | 4/1979 | Imanishi | 72/421 |
| 4,259,052 | 3/1981 | Imanishi et al. | 72/405 |

FOREIGN PATENT DOCUMENTS

| | | | |
|---|---|---|---|
| 1192969 | 5/1970 | United Kingdom | 72/422 |

*Primary Examiner*—Lowell A. Larson
*Attorney, Agent, or Firm*—Wenderoth, Lind & Ponack

[57] ABSTRACT

A feed bar driving apparatus for a transfer press. A pair of carriers is located at each of the ends of two parallel feed bars. The carriers each have vertically movable feed bar receptacles thereon for holding the feed bars for permitting them to slide freely in the direction of their length while restricting their movements in the lateral direction and move toward and away from each other in clamping and unclamping movements. A rack mechanism between the carriers has a rack attached to each carrier, a pinion engaging each rack and located at positions between the corresponding carriers and the center of the space between the carriers, and an even number of idler gears connected between the pinions for driving the pinions in opposite directions of rotation. A cam carrying slide member slides reciprocally on the press. A reciprocating mechanism is connected to one of the carriers in each pair and there is a reciprocal motion producing cam on the slide member acting on a cam follower to drive a connecting rod connected to the one carrier for reciprocatingly driving the one carrier. An elevating mechanism elevates the feed bar receptacles by an elevating plate and a linkage, and a rotation producing mechanism rotates a splined shaft to drive the linkage.

10 Claims, 17 Drawing Figures

FEED BAR DRIVING APPARATUS FOR A TRANSFER PRESS

BACKGROUND OF THE INVENTION AND PRIOR ART

The present invention relates to a feed bar driving apparatus for a transfer press which can selectively perform two-dimensional and three-dimensional feeding of feed bars.

A transfer press is provided with a transfer device which automatically transfers materials to be processed, and this transfer device comprises two feed bars which are arranged parallel to each other and on both sides of the dies in the press, and a feed bar driving device. Two-dimensional feeding is carried out by causing the grip fingers of the feed bars to engage the material to be transferred by first operating the bars to move them toward each other for clamping or gripping the material, then advancing or feeding the material by moving the feed bars in the direction of their length, unclamping and returning the feed bars to the initial position. Three-dimensional feeding, on the other hand, is carried out by adding up-and-down movements or lifting and lowering to the steps of the two-dimensional feeding, and materials are transferred by operating the feed bars to carry out clamping, lifting, advancing, lowering, unclamping and returning.

Unlike the two-dimensional feeding apparatus, because it has only been a short time since the three-dimensional feeding apparatus was first developed, there are few apparatuses among the conventional three-dimensional feeding apparatuses which can transfer materials surely and accurately and at high speed.

As described above, in the three-dimensional feeding operation, up-and-down movements are added to the steps of the two-dimensional feeding, and many of the conventional apparatuses perform both two-dimensional and three-dimensional feeding using a single driving mechanism. In this kind of conventional device, the driving mechanism for carrying out up-and-down movements is incorporated in the mechanism for carrying out the other movements, and thus the device as a whole must be large, requiring a big transfer unit housing.

In recent years, there have been developed presses in which the feed bars have portions that are shorter than the internal length of the press and which have the finger grips thereon, and portions which perform transfer movements and which are connected to the transfer unit housing, and thus the feed bar portions inside the press, i.e., the portions with finger grips, must be drawn outside the press along with the dies when die exchange is to be carried out. When the transfer unit housing is large as described above, it is difficult to draw the feed bar portions which are inside the press out of the press, and further in order to make the portions of the feed bars separable so as to make it possible to draw the shorter ones out of the press with the dies, the press frame must be large, which increases the size between the press columns.

Also, in the conventional clamping and unclamping mechanisms, a rack is provided on each of the carriers which support the feed bars and serves to actuate them to carry out clamping and unclamping movements. The two racks are positioned so that each of them extends toward the other carrier, and they are engaged with a pinion provided between the two carriers. Clamping and unclamping movements are performed by reciprocating the carriers by driving the racks. However, the two racks engaged with the pinion must engage it at a position where the carriers are farthest from each other, and each of these carriers can approach the other only to the point where it runs into the end of the rack of the other carrier which it faces. Thus, there is a disadvantage that clamping movements of the feed bars can be carried out only through a limited distance.

OBJECTS AND BRIEF SUMMARY OF THE INVENTION

It is an object of the present invention to improve the conventional press and to provide a transfer driving apparatus which insures reliable and accurate transfer of materials to be processed in a high-speed operation by performing both the two-dimensional and three-dimensional feeding movements by independent mechanisms.

Another object of the present invention is to provide an economical press by making the overall size compact by decreasing the distance between the press columns with respect to the space required for taking out the feed bars, while making such space as large as possible by miniaturizing the transfer unit housing.

Still another object of the present invention is to provide a transfer driving apparatus in which a pinion is provided for each of the racks on the carriers which support the feed bars, the pinion being at a position closer to the corresponding carrier than the mid-point between the carriers so that each rack is engaged with its own pinion, so that by continuously driving the two pinions through intermediate gears, the space available for clamping can be made larger than in those transfer driving mechanisms in which only a single pinion is provided at the mid-point between a pair of carriers.

BRIEF DESCRIPTION OF THE DRAWINGS

The invention will now be described in greater detail in connection with the accompanying drawings, in which.

DETAILED DESCRIPTION OF THE INVENTION

Figure 1:
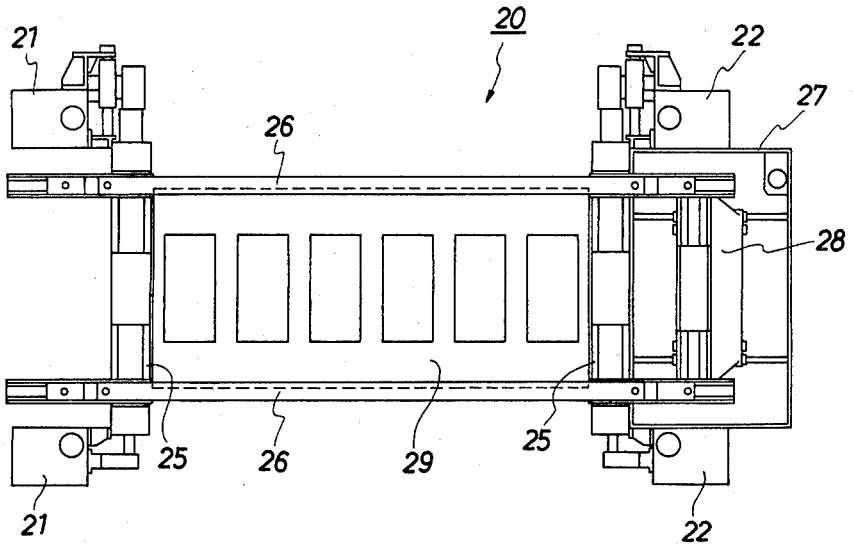
FIG. 1 is a plan view of the transfer press of the present invention viewed from the upper part of the bolsters.
Figure 2:
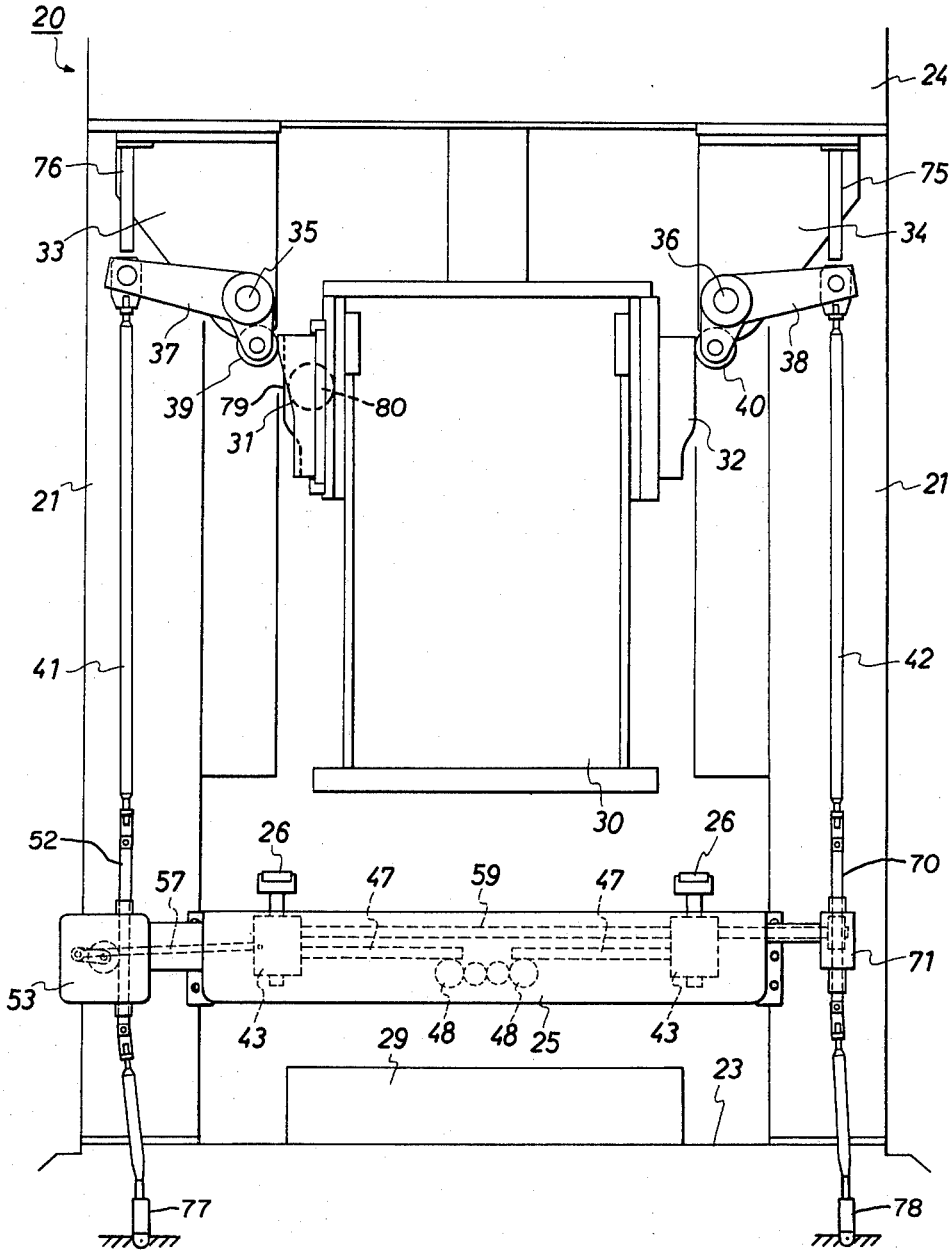
FIG. 2 is an end elevation view of the transfer press of FIG. 1.
Figure 3:
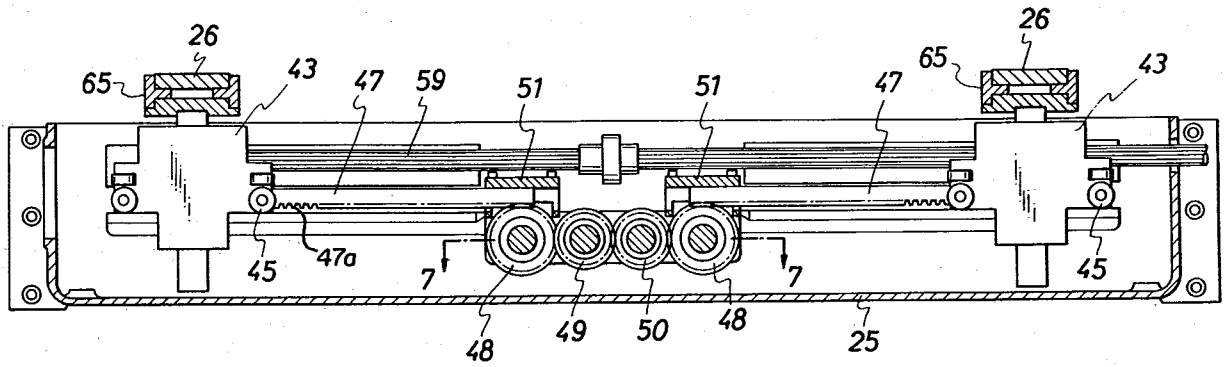
FIG. 3 is a sectional end elevation view, on an enlarged scale, of the unit housing in which the clamping and unclamping mechanisms is housed.
Figure 4:
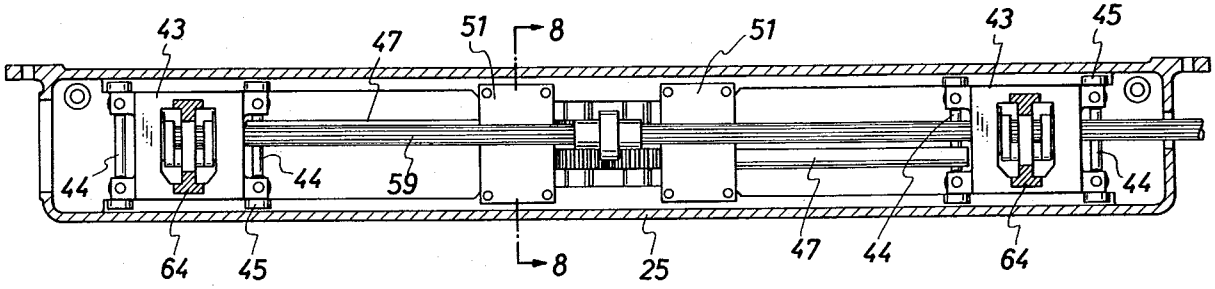
FIG. 4 is a plan view of the housing of FIG. 3.
Figure 5:
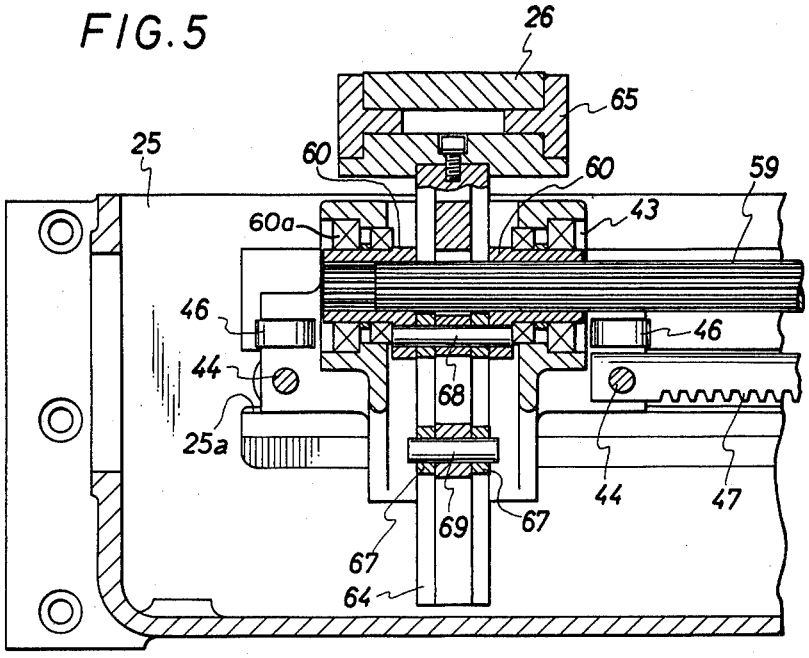
FIG. 5 is an elevation, partially in cross-section and on an enlarged scale, of part of the housing shown in FIG. 3 and showing in detail the carrier which supports the feed bars in the housing.
Figure 6:
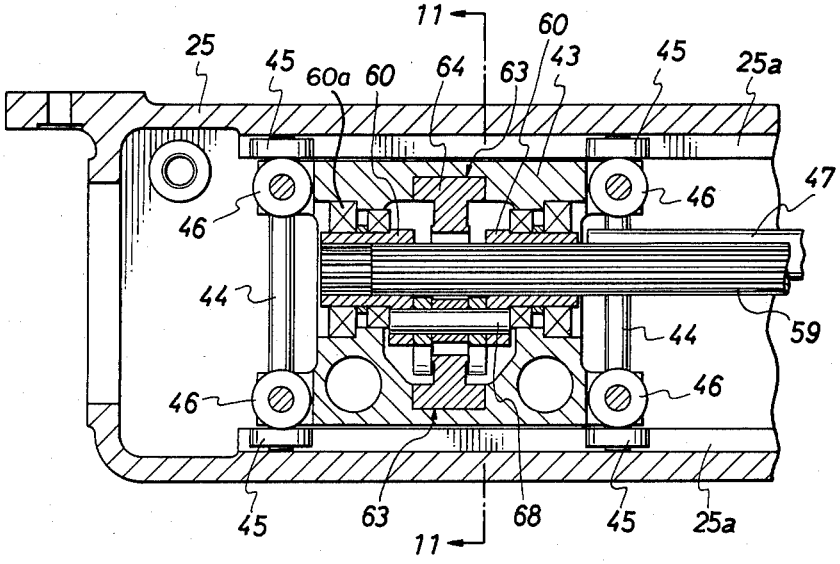
FIG. 6 is a plan view, partly in section, of the structure shown in FIG. 5.
Figure 7:
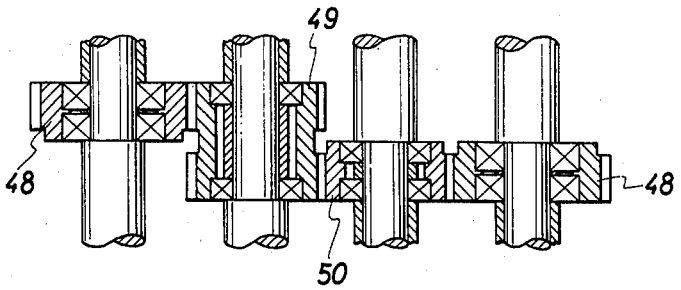
FIG. 7 is a cross-section taken on line 7—7 of FIG. 3.
Figure 8:
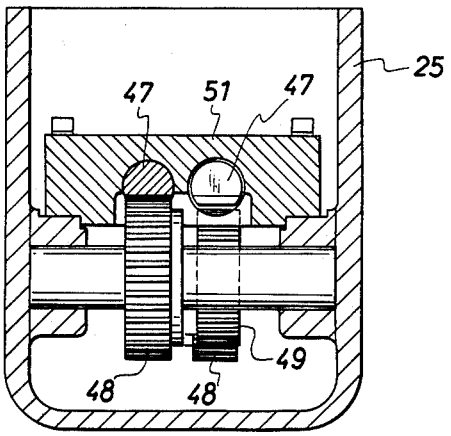
FIG. 8 is a cross-section taken on line 8—8 of FIG. 4.

Now the present invention will be explained in detail, with reference to the embodiment shown in the drawings.

The transfer press 20 generally has a rectangular shape with two left-hand columns 21, and two right-hand columns 22, 22. A bed 23 is provided at the bottom of the columns, and it is connected and fixed to a crown 24 by tie rods (not shown) provided in the columns 21 and 22. Between the two left-hand columns 21 and between the two right-hand columns 22, are provided first housings 25 for the mechanism for clamping and unclamping as well as for lifting and lowering movements of the carriers during a transfer operation. Two feed bars 26 which are parallel to each other are connected to the first housings 25. The parts of the feed bars 26 which are between the righthand columns 22 are connected to a slider 28 which is provided in a second housing 27 provided between the columns 22 for advance-and-return movements of the feed bars during a transfer operation.

The feed bars 26 are separable at the portions just outside the first housings, and the portions separated from the remainder of the bars and which extend between the two housings 25 can be moved laterally of the press together with the dies when a bolster 29 placed on the bed 23 is transferred.

A cam 31 for producing clamping and unclamping movements and a cam 32 for producing lifting and lowering (up-and-down) movements are mounted on a slide 30 above each housing 25, and the slide is raised and lowered by connecting rods driven by a crank shaft (not shown) provided in the crown 24 and connected to the rods. The cams are mounted on the slide so that their mounting positions can be changed.

The cams 31 and 32 are respectively in contact with rollers 39 and 40 which are mounted on the ends of levers 37 and 38 which in turn are rotatably mounted on shafts 35 and 36 on brackets 33 and 34 provided on the crown 24. A rod 41 is connected to the other end of each lever 37 and extends downward along the columns 21. The clamping and unclamping mechanism in each housing 25 is driven by reciprocating movement of the corresponding rod 41. A rod 42 is connected to the other end of each lever 38 and extends downward along the columns 21. The lifting and lowering mechanism in each housing 25 is driven by the corresponding rod 42.

In each housing 25 is a pair of transferrable carriers 43 for supporting the feed bars and which are movable in the direction perpendicular to the length of the feed bars at the front and rear of each of the carriers 43 are vertical wheels 45 mounted on axles 44 which roll on groove-like rails **25*a* which are formed on the opposite inner surfaces of the housing 25 and which extend longitudinally therein in a direction across the space between the feed bars. Also at the front and rear of each of the carriers 43 are second wheels 46 which rotate in the horizontal direction and which roll along the side faces of the rails 25*a*. The carriers 43** can thus travel reciprocatingly along the rails, being supported by the wheels at the front and rear as well as on both sides.

On the surface of each pair of carriers 43, which face each other is mounted a rack 47 extending toward the other carrier of the pair, and the racks 47 are parallel and spaced transversely of the length thereof so that they can pass each other, and the racks 47 have a length such that they do not reach the center of the housing when the carriers are at positions furthest from the center of the space between the feed bars. On the bottom of the racks 47 are teeth **47*a* which engage with pinions 48, mounted on pins in the housings 25, and the pinions 48 are engaged by two intermediate gears 49 and 50, respectively. The gear 49 engages with the other gear 50 and at the same time, on the other side it engages one of the pinions 48. Thus, when one of the two carriers 43 is transferred along the rails 25*a*, the other carrier is also driven in the opposite direction along tracks 25*a*. Also, since the ends of the two racks 47 are spaced from the center of the housing 25 when the carriers 43** are spaced farthest apart, it is possible to cause the two carriers to approach closer to each other than in the conventional apparatus in which the end of the racks extend past the center of the housing toward the other carrier, and as a result of this structure of the present invention, the clamping space is made larger.

In order to ensure the engagement of the pinions 48 and the racks 47, rack guides 51 are fixed in the housing 25 above the pinions 48 and engage the top edges of the racks for guiding them and holding them in engagement with the pinions.

Figure 10:
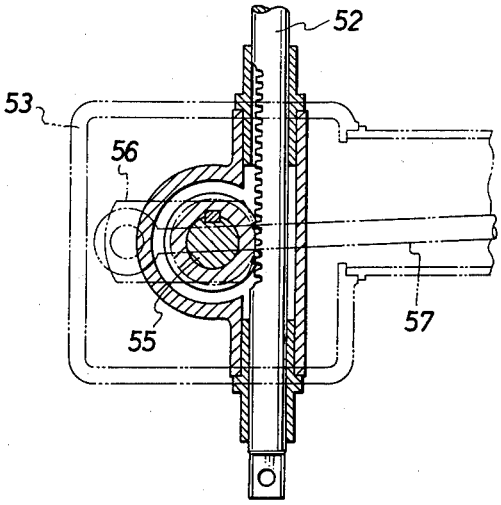
FIG. 10 is a cross-section taken on line 10—10 of FIG. 9.
Figure 11:
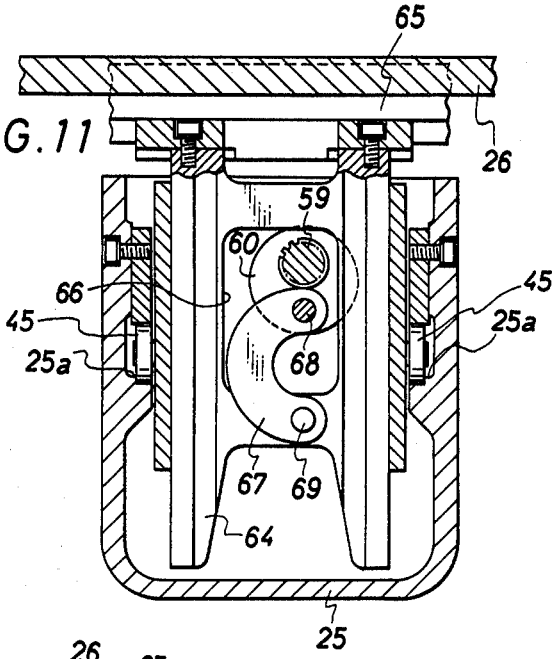
FIG. 11 is a cross-section taken on line 11—11 of FIG. 6, showing the carrier in detail.
Figure 12:
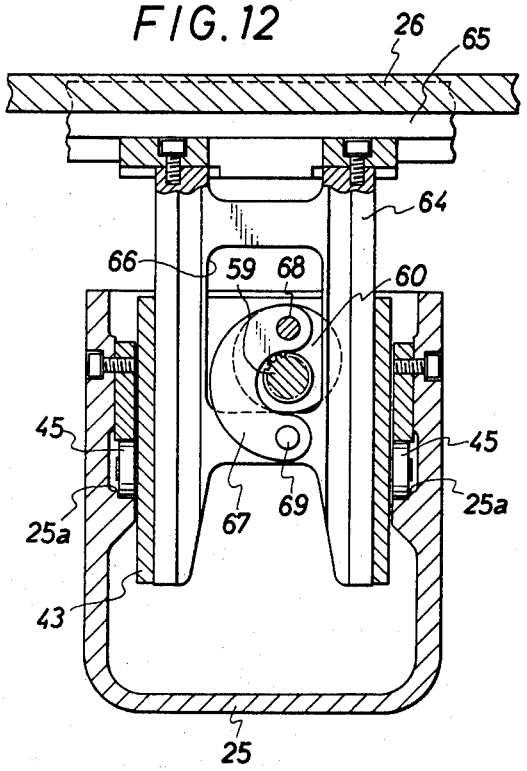
FIG. 12 is a view similar to FIG. 11 showing the feed bars in the elevated position.
Figure 13:
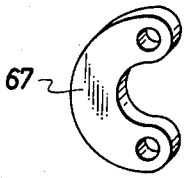
FIG. 13 is a perspective view of the link member which lifts the feed bars.
Figure 16:
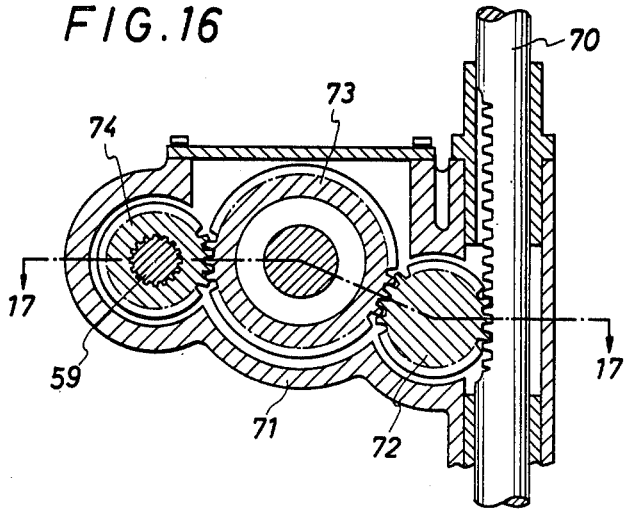
FIG. 16 is a cross-section of the rotating mechanism which drives the splined shaft incorporated in the housing.
Figure 17:
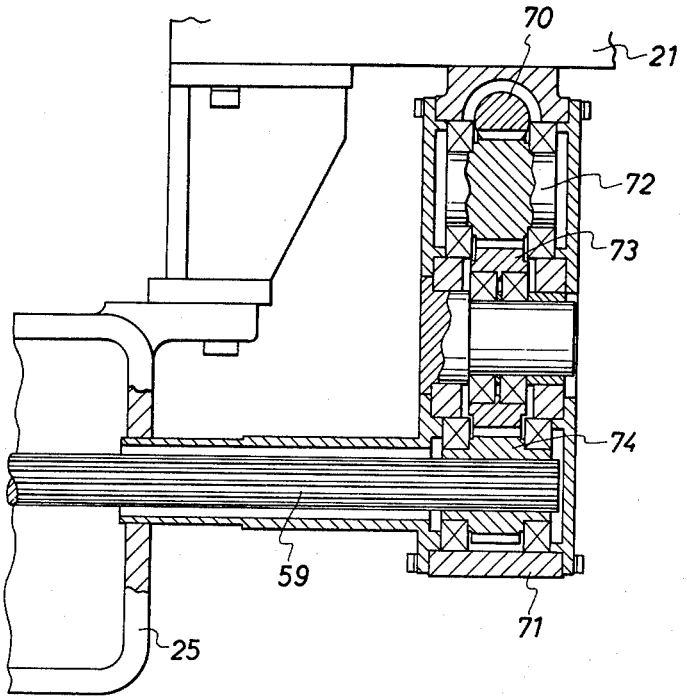
FIG. 17 is a cross-section taken on line 17—17 of FIG. 16.

The lower ends of the rods 41 driven by the cams 31, for providing clamping and unclamping movements by transferring the carriers 43, extend towards the vicinity of the ends of the respective housings 25. The lower end of each rod is connected to a rack rod 52 (FIG. 10) by a universal joint, which is housed in a casing 53 which is mounted on a corresponding left column 21 so that its mounting position can be changed. In the casing 53 is a pinion 54 which engages with the teeth of the rack rod 52 and a crank plate 56 is mounted on a pinion shaft 55 which is driven by the pinion 54. A connecting rod 57 is pivotally connected to the crank shaft 56.

The connecting rods 57 from the respective casings 53 are connected to the axles 44 on the ends of the respective carriers 43, and the reciprocating movements of the connecting rods 57 driven by rotation of the pinion shafts 53 reciprocally drive the carriers 43 in the housing 25.

Each casing 53 is slidably mounted on a rod **53*a* fixed on an adjacent column 21 and is connected to a piston-cylinder mechanism 58 also mounted on the column 21, and by varying the positions of the respective casings 53 by actuating the piston-cylinder mechanisms 58, the distance between the two carriers 43 can be varied, and thus the clamping space between the feed bars 26 supported on the carriers can be adjusted. Each casing 53 and the housing 25 are connected to each other by a connecting sleeve 53*b* which surrounds the corresponding connecting rod 57. The connecting sleeve is fixed to the casing 53 and is slidable into and out of the housing 25**.

In order to ensure the contact between the rollers 39 and the cams 31 for the clamping and unclamping movements, the ends of the rack rods 52 connected to the rods 41 protrude downward past the casings 53 and are connected to piston-cylinder mechanism 77 provided at the bottom of the bed 23 so as to pull the rods 41 downward.

Figure 14:
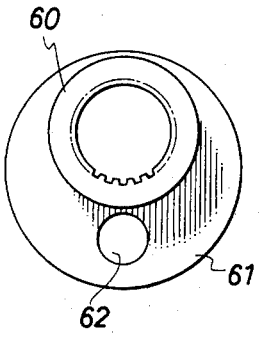
FIG. 14 is a front view of the rotating cylinder which drives the link member by engaging it with the splined shaft.
Figure 15:
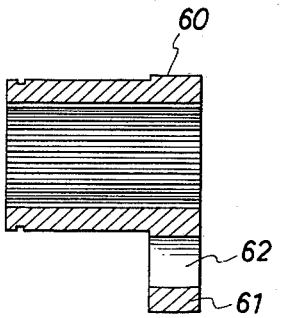
FIG. 15 is a cross-section of the cylinder of FIG. 14.
Figure 9:
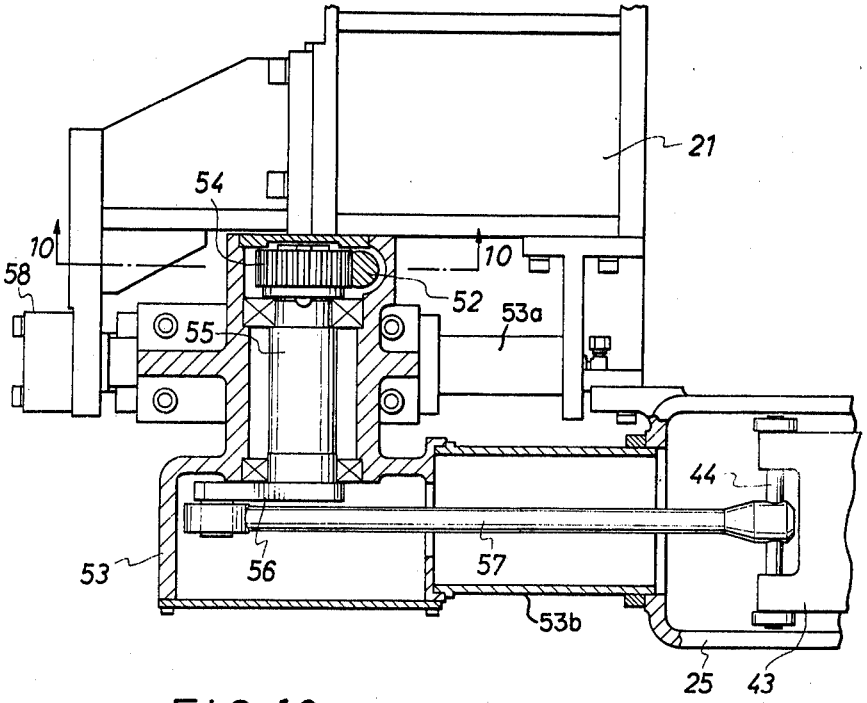
FIG. 9 is a plan view, partially in cross-section, of the reciprocating mechanism which drives the carrier in the housing.

A splined shaft 59 extends between and through both carriers 43 of each pair of carriers, and at the ends thereof it engages with cylinders 60 which are rotatably mounted on bearings 60*a* in the carriers 43. The carriers 43 are slidable along the splined shafts 59. A crank shaft 61 (FIGS. 14 and 15) is provided on each rotating cylinder 60 at a position eccentric to the central longitudinal axis thereof, and a mounting hole 62 is provided in the crank shaft 61.

Around the inside surface of each carrier 43 in the space where the rotating cylinder 60 is provided are two vertical opposed guide grooves 63 extending perpendicularly to the splined shaft 59. An elevating plate 64 is slidably mounted in each such pair of guide grooves. On the upper ends of the elevating plates 64 in each carrier 43 is mounted a feed bar receptacle 65, and the feed bars 26 are supported in the receptacles 65 for the respective carriers 43 so as to be freely movable in the longitudinal direction of the feed bars.

To accommodate the splined shafts 59 extending through the carriers 43, an opening 66 is provided in each elevating plate 64 at the position where the corresponding splined shaft 59 and crank member 61 on the rotating cylinder 60 extend therethrough, and arcuate link members 67 are positioned in front of and behind each plate 64 and are connected at one end by a pin 68 to the mounting hole 62 of the corresponding crank member 61. The other ends of the link members 67 are connected to the corresponding elevating plate 64 by a pin 69.

When the splined shafts 59 are rotated, the cylinders 60 are also rotated, and the crank members 61 are rotated to raise the link members 67, causing, in turn, the plate 64 to rise. Since each link member 67 has a recess therein, the splined shaft 59 will be accommodated in the recess when the shaft is rotated and the plate 64 is elevated. Thus, the splined shaft 59 will not hinder up-and-down travel of the plate 64.

The lower end of each of the rods 42 driven up and down by the cams 32 for rotating the splined shafts 59, extends to the vicinity of the end of the housing 25. The rod end is connected to a rack rod 70 through a universal joint and the rack rod 70 is housed in a casing 71 mounted on a column 21. In the casing 71 is an idle gear 74 a mid pinion 73 meshed therewith and which meshes with a pinion 72 which, in turn, meshes with the teeth of the rack rod 70. The corresponding splined shaft 59 extends beyond the carrier 43 which is closer to the rod 42 and has the pinion 74 mounted thereon.

In order to ensure contact between each lever 38 and the cam 32 for providing the up-and-down movement, each rod 42 is connected through the rack rod 70 to a piston-cylinder device 78 provided at the bottom of the bed 23 so that the rods 42 are pulled downward.

When the slide 30 is moved upward and downward, the rods 41 and the rack rods 52 are reciprocated by the cams 31 through the levers 37, and the crank plates 56 are rotated the rotation of the pinions 54 which are driven by the rack rods 52. Since the connecting rods 57 which are connected to the crank plates 56, are connected to the corresponding carriers 43, the carriers of each pair of carriers 43 are driven toward and away from each other through the racks 47, the pinions 48 and the intermediate gears 49 and 50, whereby the movements of the rods 41 are converted to reciprocating movements of the carriers 43. Thus, the feed bars 26 carried by the carriers 43 perform clamping and unclamping movements.

The cam 32 for providing up and down movements, on the other hand, causes reciprocating movements of the rods 42 when the slide 30 is moved upward and downward, and the idle gears 74 are rotated by the rack rods 70 through pinions 72 and 73, thereby rotating the splined shafts 59 and moving the elevating plates 64 in the carriers 43 upward and downward so as to cause up and down movements of the feed bars 26 carried in the feed bar receptacles 65. Thus, by this structure, it is possible to make the feed bars 26 to perform both clamping and unclamping and up and down movements simply by upward and downward movements of the slide 30. When the two cams are operated simultaneously, the feed bars perform three-dimensional movements, since by properly positioning the cams 31 and 32 relative to each other, the clamping and unclamping and up and down movements are caused to occur with the desired timing. However, when only two dimensional movements are desired, it is possible to cause the feed bars to perform only clamping and unclamping movements by separating the cam 32 for up and down movements and the lever 38 by butting the lever against a butting member 75 provided on the crown by the piston-cylinder device 78. Cams 79 for providing only clamping and unclamping movements different from those provided by cams 31 are provided next to the cams 31 and switching of the clamping and unclamping cams is performed by first butting the lever 37 against the butting member 76 on the crown by the piston-cylinder device 77 and then by utilizing a piston-cylinder device 80 mounted in the slide 30 for shifting cams 31 out of the path of the followers 39 and shifting cams 79 into the path.

Thus, the apparatus of the present invention can carry out either two dimensional or three dimensional feeding of the feed bars, and the space between the feed bars can be adjusted. Moreover, because idle gears are provided between the racks extending between the pairs of carriers which support the feed bars, it is possible to shorten the length of the racks, and as a result of this the apparatus of the invention provides a larger space within which clamping can take place, so that a press having the apparatus of the present invention may be used for a wide variety of purposes.

What is claimed is:

1. A feed bar driving apparatus for a transfer press having two parallel feed bars, comprising:

a pair of carriers located at each of the ends of the two parallel feed bars, said carriers each having vertically movable feed bar receptacles thereon for holding the feed bars for permitting them to slide freely in the direction of their length while restricting their movements in the lateral direction, the carriers in each pair being movable toward and away from each other for moving said feed bars in clamping and unclamping movements;

a rack mechanism between each pair of carriers and having a rack attached to each carrier, a pinion engaging each said rack, said pinions located at positions between the corresponding carriers and the center of the space between the carriers, and an even number of idler gears connected between said pinions, for driving said pinions in opposite directions of rotation;

a cam carrying slide member reciprocally slidable on said press;

a reciprocating mechanism connected to one of said carriers in each pair and having a reciprocal motion producing cam on said slide member, reciprocating cam follower means actuated by said cam, and a connecting rod connected between said cam follower means and said one carrier for reciprocatingly driving said one carrier from the reciprocating sliding movement of said slide;

an elevating mechanism for said feed bar receptacles in each pair of carriers and having a splined shaft extending through both carriers in each pair and along which said carriers are slidable, an elevating plate in each carrier supporting the corresponding feed bar receptacle, a link means in each carrier connected between said splined shaft and said elevating plate for raising and lowering said elevating plate when said splined shaft is rotated; and a rotation producing mechanism for each splined shaft and having a rotation producing cam on said slide member, rotation cam follower means actuated by said rotation producing cam, and a pinion on said splined shaft to which said rotation cam follower means is connected.

2. A feed bar driving apparatus as claimed in claim 1 further comprising a housing for each of said pairs of carriers, each said housing having groove-like rails on the inner walls thereof, and first wheels on the front and rear portions of each of said carriers and engaged in said rails, and further horizontally rotatable wheels on each of said carriers and engaging the side faces of said rails.

3. A feed bar driving apparatus as claimed in claim 1 in which said racks are on the surfaces of said carriers in each pair of carriers which face each other and are spaced transversely of the length thereof so that they can pass each other, and there are two idler gears between said pinions.

4. A feed bar driving apparatus as claimed in claim 1 in which said reciprocating cam follower means comprises a reciprocating motion producing lever having a roller which contacts the corresponding reciprocal motion producing cam, a reciprocating motion producing rod means connected to said reciprocating motion producing lever and which is reciprocated thereby and which has gear teeth thereon, a reciprocating motion pinion engaged with the gear teeth on said reciprocating motion producing rod means, and a crank plate on said reciprocating motion pinion, the corresponding connecting rod being pivotally connected to said crank plate.

5. A feed bar driving apparatus as claimed in claim 4 in which said reciprocating cam follower means further comprises a casing in which said reciprocating motion pinion is mounted, and said rod means has a rack section with said gear teeth thereon extending into said casing and a rod section connected to said lever and a universal joint connecting said rod and said rack sections, said casing being mounted on the press for movement toward and away from the corresponding carriers for adjusting the space between feed bars.

6. A feed bar driving apparatus as claimed in claim 1 in which said elevating plates each have an opening therethrough through which the corresponding splined shaft extends, said elevating plate being slidable in the carrier in the direction of its length and having the corresponding feed bar receptacle mounted on the upper end thereof, and said link means comprises a cylinder slidably mounted on the corresponding splined shaft and being rotatable in the corresponding carrier, and a crankshaft on said cylinder, and a pair of link members connected between said crankshaft and the elevating plate, one on each side of said elevating plate.

7. A feed bar driving apparatus as claimed in claim 6 in which each carrier has on the inside thereof two guide grooves which face each other and the corresponding elevating plate being slidable in said grooves.

8. A feed bar driving apparatus as claimed in claim 6 in which said link members are curved and have a recess therein, and in the raised position of the elevating plate, said link members curve around said splined shaft.

9. A feed bar driving apparatus as claimed in claim 1 in which each rotation cam follower means comprises a rotation producing lever having a roller which contacts the corresponding rotation producing cam, a rotation producing rod means connected to said rotation producing lever and which is reciprocated thereby and which has gear teeth thereon, and a rotation producing pinion means engaged with the gear teeth on said rotation producing rod means and connected to the corresponding splined shaft.

10. A feed bar driving apparatus as claimed in claim 1 further comprising means for holding said rotation cam follower means out of engagement with said rotation producing cam, whereby only said reciprocating mechanism is operable.

* * * * *